US009804561B2

(12) United States Patent
Mikami

(10) Patent No.: US 9,804,561 B2
(45) Date of Patent: Oct. 31, 2017

(54) IMAGE FORMING APPARATUS

(71) Applicant: FUJI XEROX CO., LTD., Tokyo (JP)

(72) Inventor: Masato Mikami, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/208,743

(22) Filed: Jul. 13, 2016

(65) Prior Publication Data

US 2017/0205765 A1 Jul. 20, 2017

(30) Foreign Application Priority Data

Jan. 14, 2016 (JP) ..... 2016-005518

(51) Int. Cl.
*G03G 21/20* (2006.01)

(52) U.S. Cl.
CPC ..... *G03G 21/206* (2013.01)

(58) Field of Classification Search
None
See application file for complete search history.

(56) References Cited

U.S. PATENT DOCUMENTS

2010/0216069 A1* 8/2010 Yang ..... G03G 9/0806 430/137.14
2011/0211860 A1* 9/2011 Shimoyama ..... G03G 15/2064 399/93
2014/0341607 A1* 11/2014 Nakano ..... G03G 15/2017 399/92

FOREIGN PATENT DOCUMENTS

JP 2010-107637 A 5/2010
JP 2011-059359 A 3/2011
JP 2013-195810 A 9/2013
JP 2015-031896 A 2/2015

* cited by examiner

*Primary Examiner* — Thomas Giampaolo, II
(74) *Attorney, Agent, or Firm* — Sughrue Mion, PLLC

(57) ABSTRACT

An image forming apparatus includes a body having a port, an image forming section positioned further than the center of the body toward a first side while including an image forming unit that forms an image on a medium by a developer including an additive and a fixing unit that heats and fixes the image onto the medium, a duct extending from the vicinity of the fixing unit to a position further than the center of the body toward a second side, a connecting portion connected to a portion of the duct, which is farthest from the fixing unit, and the port on the second side while being wider than the duct such that a flow velocity of a gas inside the connecting portion is less than that inside the duct, and a moving unit that moves the gas from the fixing unit to the connecting portion through the duct.

17 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2016-005518 filed Jan. 14, 2016.

BACKGROUND (i) Technical Field

The present invention relates to an image forming apparatus.

(ii) Related Art

There is a case where an additive, such as a release agent, included in a developer becomes fine particles each having a diameter of 0.1 μm or less as a result of being vaporized by being heated by a fixing device and then solidified by being cooled in an image forming apparatus. When air containing fine particles that are present in the vicinity of the fixing device is discharged via a duct, the fine particles are less likely to be bonded to one another if the time taken for the air to be discharged through a discharge port of an apparatus body of the image forming apparatus is short, and thus, there is a possibility that the fine particles may be discharged in their unbonded state to outside the apparatus body of the image forming apparatus.

In a configuration in which an image forming section, in which an image forming operation is performed, is positioned in a center portion of the apparatus body in the width direction, it is difficult to form, between the image forming section and the apparatus body, a large space, which is to be used for increasing the time needed for the fine particles to bond to one another. Thus, in the configuration in which the image forming section is positioned in the center portion of the apparatus body in the width direction, it is difficult to widen the duct, and accordingly, the time taken for the air to be discharged is likely to be short. As a result, there is the possibility that some of the fine particles may be discharged to outside the apparatus body without being bonded to the other fine particles.

SUMMARY

According to an aspect of the invention, there is provided an image forming apparatus including an apparatus body in which a discharge port is formed, an image forming section that is positioned further than the center of the apparatus body in a width direction toward a first side and that includes a developer-image forming unit that forms a developer image on a recording medium by using a developer including an additive and a fixing unit that fixes the developer image onto the recording medium by heating the developer, a duct that extends, in the apparatus body, from a vicinity of the fixing unit to a position further than the center of the apparatus body in the width direction toward a second side, a connecting portion that is connected, on the second side in the apparatus body, to a portion of the duct, which is opposite to a portion of the duct that faces the fixing unit, and the discharge port and that is formed so as to be wider than the duct in such a manner that a flow velocity of a gas that flows inside the connecting portion is less than a flow velocity of a gas that flows inside the duct, and a moving unit that causes the gas to move from the fixing unit to the connecting portion by passing through the inside of the duct.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
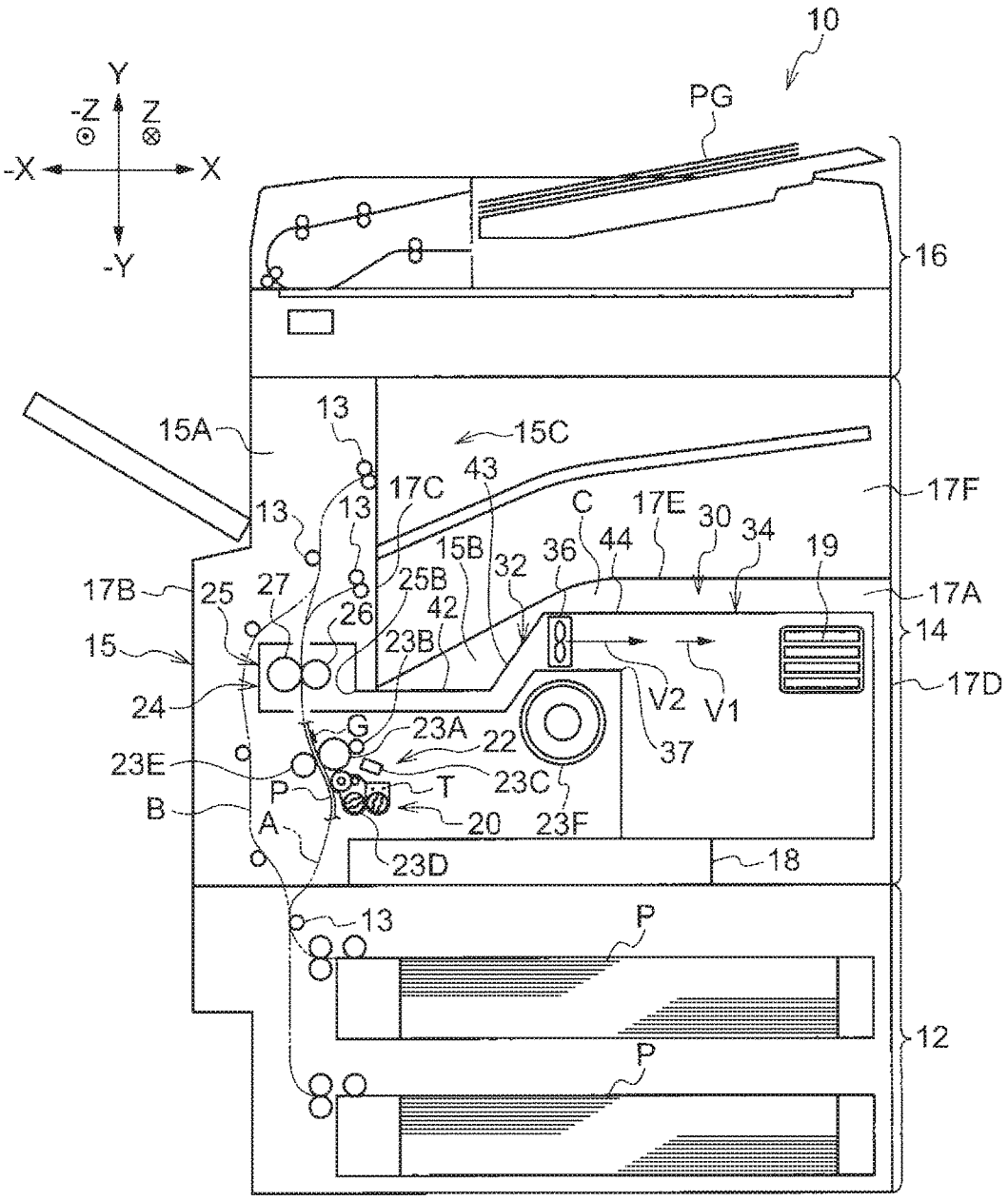
FIG. 1 is a schematic diagram illustrating the overall configuration of an image forming apparatus according to a first exemplary embodiment of the present invention.

An image forming apparatus 10 according to a first exemplary embodiment of the present invention, which is illustrated in FIG. 1, will be described as an example of an image forming apparatus. Note that, in the following description, the direction indicated by arrow Y illustrated in FIG. 1 is the height direction of the image forming apparatus 10, and the direction indicated by arrow X illustrated in FIG. 1 is the width direction of the image forming apparatus 10. In addition, a direction (indicated by Z) that is perpendicular to the height direction and the width direction is the depth direction of the image forming apparatus 10. Furthermore, the width direction, the height direction, and the depth direction when the image forming apparatus 10 is viewed from the side on which a user, who is not illustrated, stands (as viewed from the front), will be respectively referred to as the X direction, the Y direction, and the Z direction. In the case where it is necessary to describe each of the X direction, the Y direction, and the Z direction in such a manner as to be distinguished in terms of positive and negative direction components, an upward direction, a downward direction, a right direction, a left direction, a backward (rearward) direction, and a forward direction when the image forming apparatus 10 is viewed from the front will be respectively referred to as the positive Y direction, the negative Y direction, the positive X direction, the negative X direction, the positive Z direction, and the negative Z direction.

As an example, the image forming apparatus 10 includes a sheet-accommodating section 12 that accommodates sheets P, a body section 14 that is disposed further than the sheet-accommodating section 12 toward the positive Y direction side and that performs image formation on one of the sheets P by using a toner T, and an image reading section 16 that is disposed further than the body section 14 toward the positive Y direction side and that reads images of documents PG. The sheets P in the sheet-accommodating section 12 are to be transported by plural rollers 13 that are disposed on a sheet transport path A, which will be described later.

The body section 14 includes a housing 15, which is an example of an apparatus body, a control unit 18, an image forming section 20, and a discharge unit 30. The control unit 18, the image forming section 20, and the discharge unit 30 are disposed in the housing 15. Each of the sheets P is an example of a recording medium. The toner T is an example of a developer. A toner image G that is formed by using the toner T is an example of a developer image.

<Housing>

The housing 15 includes a transport chamber 15A to which the sheets P are to be transported and an accommodating chamber 15B (described later) that accommodates the image forming section 20 and the discharge unit 30. When the housing 15 is viewed in the Z direction, the transport chamber 15A extends in the Y direction at a position further than the center of the housing 15 in the X direction toward the negative X direction side. The accommodating chamber 15B extends toward the positive X direction side from a portion of the transport chamber 15A, the portion being located on the negative Y direction side and the positive X direction side, and is internally connected to the transport chamber 15A. The height of the accommodating chamber 15B in the Y direction is lower than the height of the transport chamber 15A in the Y direction. Here, a space surrounded by the transport chamber 15A, the accommodating chamber 15B, and the image reading section 16 will be referred to as an ejecting section 15C.

The transport chamber 15A is surrounded by a front wall (not illustrated) that is included in the housing 15, a rear wall 17A, a left wall 17B, and an intermediate wall 17C. Each of the front wall and the rear wall 17A extends along an XY plane. The front wall, which is not illustrated, is formed in an L shape as viewed in the Z direction. The rear wall 17A is formed in a quadrangular shape as viewed in the Z direction. A discharge port 19 having plural long through holes, each of which extends in the Z direction, is formed in a portion of the rear wall 17A, the portion being located further than the center of the rear wall 17A in the X direction toward the positive X direction side and being located at the center of the rear wall 17A in the Y direction. The left wall 17B is a side wall extending along a YZ plane at an end of the housing 15, the end being located on the negative X direction side. The intermediate wall 17C is a wall that isolates the transport chamber 15A and the ejecting section 15C from each other. More specifically, the intermediate wall 17C extends along the YZ plane at a position further than the center of the housing 15 in the X direction toward the negative X direction side and covers a portion of the transport chamber 15A, the portion being located further than the center of the transport chamber 15A in the Y direction toward the positive Y direction side and the positive X direction side.

In the transport chamber 15A, the sheet transport path A and an inversion transport path B each extending in the Y direction are formed. The sheet transport path A is a path along which one of the sheets P that has been sent out from the sheet-accommodating section 12 is to be transported by the plural rollers 13 and to which one of the sheets P is to be guided by a guiding member (not illustrated). The sheet transport path A extends in such a manner that an upper end thereof reaches an opening (not illustrated) that is formed in the intermediate wall 17C. The inversion transport path B is a transport path to which one of the sheets P is to be sent from the sheet transport path A in the case of forming an image on a rear surface of the sheet P.

The accommodating chamber 15B is surrounded by the above-mentioned front wall (not illustrated), the rear wall 17A, a right wall 17D, a top wall 17E, and a bottom wall 17F. The right wall 17D is a side wall extending along a YZ plane at an end of the housing 15, the end being located on the positive X direction side. The top wall 17E is a wall that isolates the accommodating chamber 15B and the ejecting section 15C from each other. More specifically, the top wall 17E is a wall extending toward the positive X direction side from an end of the intermediate wall 17C, the end being located on the negative Y direction side, and covers the accommodating chamber 15B from the positive Y direction side. In addition, a portion of the top wall 17E that is positioned further than the center of the top wall 17E in the X direction toward the negative X direction side is inclined toward the end of the intermediate wall 17C on the negative Y direction side. Furthermore, a portion of the top wall 17E that is positioned further than the center of the top wall 17E in the X direction toward the positive X direction side extends approximately along an XZ plane. The bottom wall 17F is a wall that isolates the accommodating chamber 15B and the sheet-accommodating section 12 from each other.

The ejecting section 15C is surrounded by the top wall 17E, the intermediate wall 17C, and an inner wall 17G. The inner wall 17G is a wall that is positioned further than the rear wall 17A toward the negative Z direction side and that stands upright along the XY plane at an end of the top wall 17E, the end being located on the positive Z direction side. In addition, the inner wall 17G is formed so as to extend from an end of the top wall 17E, the end being located on the positive X direction side, to another end of the top wall 17E, the other end being located on the negative X direction side (the intermediate wall 17C). In other words, the ejecting section 15C is open on the positive X direction side and the negative Z direction side. Note that a circuit board (not illustrated) and the like are disposed in a space between the rear wall 17A and the inner wall 17G.

<Control Unit>

The control unit 18 includes a controller (not illustrated) that includes a computer. The control unit 18 is configured to control an operation of transporting one of the sheets P performed by the rollers 13, an image forming operation for forming the toner image G on one of the sheets P performed by the image forming section 20, and a discharge operation performed by the discharge unit 30.

<Image Forming Section>

The image forming section 20 includes an image forming unit 22, which is an example of a developer-image forming unit, and a fixing unit 24, which is an example of a fixing unit.

<Image Forming Unit>

As an example, the image forming unit 22 includes a photoconductor 23A, a charging roller 23B, an LED print head 23C (hereinafter referred to as LPH 23C), a developing unit 23D, and a transfer roller 23E. The developing unit 23D forms the toner image G on the photoconductor 23A by using the toner T. In other words, the image forming unit 22 is a unit that employs a commonly known electrophotographic system, which includes charging, light exposure, development, and transfer, and that forms the toner image G on one of the sheets P. In addition, in the housing 15, the image forming unit 22 is disposed further than the center of the housing 15 in the X direction toward the negative X direction side (a first side on which the sheet transport path A is disposed).

The image forming unit 22 uses the LPH 23C, and a space that is occupied by the LPH 23C is smaller than a space that would be occupied by an exposure unit that uses a polygon mirror. The image forming unit 22 is a unit that forms the toner image G of a monochromatic color (for example, black), and there is no other unit that forms the toner image G of a different color. In other words, in the image forming apparatus 10, the image forming unit 22 is used for forming a monochromatic image and is small, and thus, in the case where the image forming section 20 is positioned further than the sheet transport path A toward the positive X direction side, in the housing 15, a large space C is formed at a position further than the position of the image forming section 20 toward the positive X direction side. Note that, in the first exemplary embodiment, as an example, a toner cartridge 23F that supplies the toner T to the developing unit 23D is disposed in a center portion of the housing 15 in the X direction and the Y direction.

(Toner)

As an example, the toner T, which is used in the image forming apparatus 10 illustrated in FIG. 1, includes a powder containing a polyester resin. In addition, the toner T includes additives, such as a coloring agent, a release agent, and a charging-controlling agent. An example of the release agent is carnauba wax. Note that the release agent is not limited to carnauba wax and may be another wax. There is a case where a portion of the release agent in the toner T becomes dust called ultrafine particles (UFPs), which are fine particles each having a diameter of 0.1 μm or less, as a result of being vaporized (volatilized) by being heated by the fixing unit 24, which will be described below, and then solidified by being cooled in the housing 15.

(Fixing Unit)

As illustrated in FIG. 1, the fixing unit 24 is disposed on the sheet transport path A and so as to be positioned further than the image forming unit 22 toward the positive Y direction side. As an example, the fixing unit 24 includes a unit body 25, a heating roller 26 that heats the toner T (toner image G) by using a heater (not illustrated), and a pressure roller 27 that nips one of the sheets P together with the heating roller 26 so as to apply pressure to the sheet P. As an example, the axial directions of the heating roller 26 and the pressure roller 27 are in the Z direction. The fixing unit 24 heats the toner T (toner image G) on one of the sheets P, which has been transported, so as to fix the toner T (toner image G) onto the sheet P. Note that the temperature at which the heating roller 26 heats the toner T is set to a temperature at which the toner T melts and the above-mentioned release agent in the toner T vaporizes.

Figure 2:
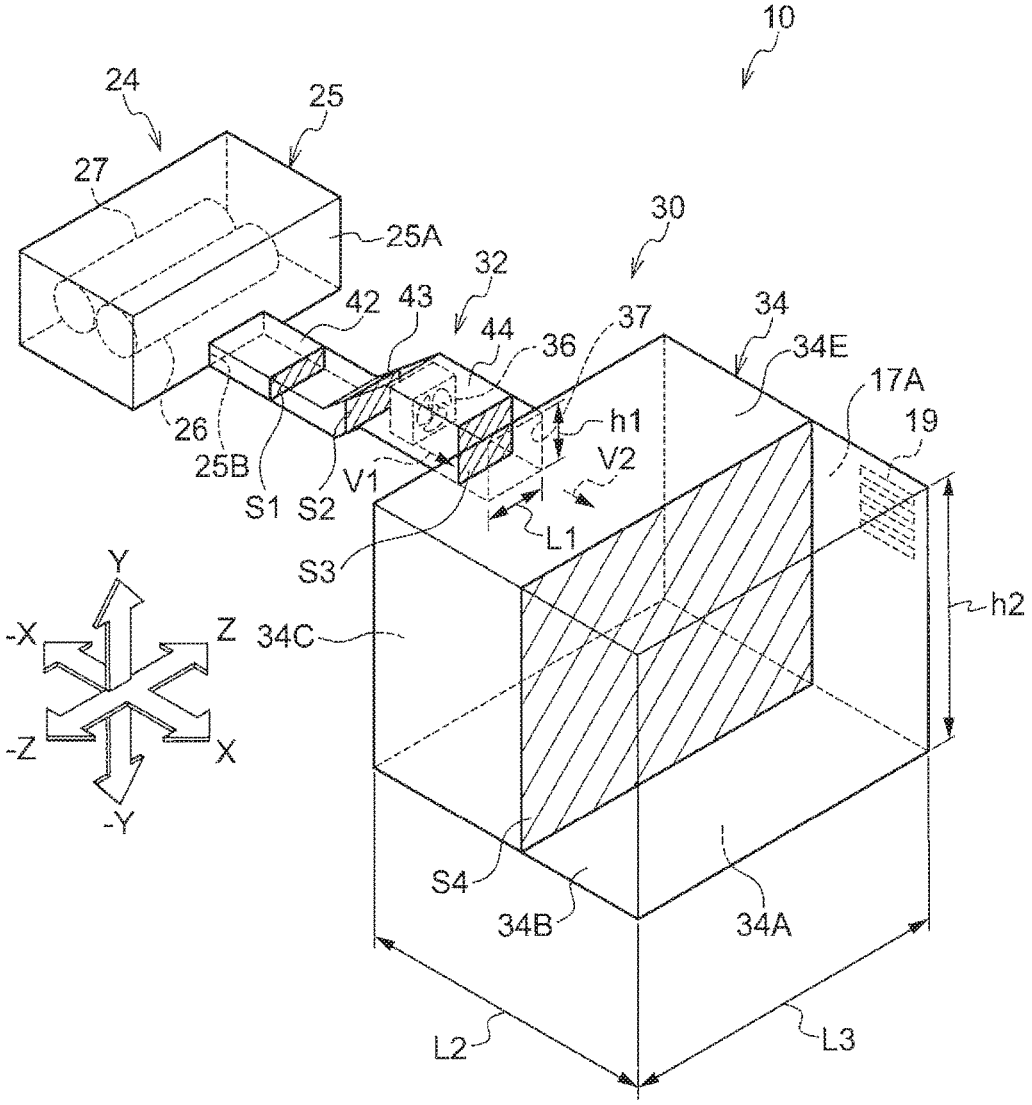
FIG. 2 is a perspective view illustrating a fixing unit, a duct, and a connecting portion according to the first exemplary embodiment.

As illustrated in FIG. 2, the unit body 25 is formed in a rectangular parallelepiped shape having a long length in the Z direction. Note that, although an opening having a size that allows one of the sheets P to pass therethrough in the Y direction is formed in each of an upper wall of the unit body 25, the upper wall being located on the positive Y direction side, and a lower wall of the unit body 25, the lower wall being located on the negative Y direction side, these openings are not illustrated in FIG. 2, FIG. 5, and FIG. 7. The above-mentioned heating roller 26 and the above-mentioned pressure roller 27 are accommodated in the unit body 25. A through hole 25B is formed in a side wall 25A of the unit body 25, the side wall 25A being located on the positive X direction side. As an example, the through hole 25B is formed in a portion of the side wall 25A, the portion being located at an end of the side wall 25A on the negative Y direction side and being located at the center of the side wall 25A in the Z direction, so as to have a rectangular shape whose longitudinal direction is in the Z direction. An end of a duct 32 (described later), the end being located on the negative X direction side, is connected to the circumferential edge of the through hole 25B. This allows a portion of a gas inside the unit body 25 to flow into the duct 32.

<Discharge Unit>

As illustrated in FIG. 2, the discharge unit 30 includes, as an example, the duct 32, a connecting portion 34 that is connected to the duct 32, and a fan 36 that is an example of a moving unit and that causes the gas to move from the fixing unit 24 to the connecting portion 34 by passing through the inside of the duct 32.

(Duct)

As illustrated in FIG. 1, in the housing 15, the duct 32 extends from the vicinity of the fixing unit 24 (the vicinity of an end portion of the fixing unit 24, the end portion being located on the positive X direction side and the negative Y direction side) to a position further than the center of the housing 15 in the X direction toward the positive X direction side (a second side). As an example, the duct 32 includes a first duct portion 42, a second duct portion 43, and a third duct portion 44. The first duct portion 42, the second duct portion 43, and the third duct portion 44 are each formed in a square cylindrical shape. In addition, as an example, the first duct portion 42, the second duct portion 43, and the third duct portion 44 each have a length L1 (see FIG. 2) in the Z direction.

As viewed in the Z direction, the first duct portion 42 is positioned further than the end of the intermediate wall 17C on the negative Y direction side toward the negative Y direction side and extends in the X direction from the circumferential edge of the through hole 25B to a position adjacent to the toner cartridge 23F on the negative X direction side (a position further than the center of the housing 15 toward the negative X direction side). In other words, the flow direction of a gas inside the first duct portion 42 is in the X direction.

As viewed in the Z direction, the second duct portion 43 is positioned further than the top wall 17E toward the negative Y direction side and positioned further than the toner cartridge 23F toward the positive Y direction side while extending diagonally upward from an end of the first duct portion 42, the end being located on the positive X direction side. More specifically, an end of the second duct portion 43, the end being located on the positive X direction side, is positioned higher than the position of another end of the second duct portion 43, the other end being located on the negative X direction side, and the flow direction of a gas inside the second duct portion 43 is inclined with respect to the horizontal direction.

As viewed in the Z direction, the third duct portion 44 is positioned further than the top wall 17E toward the negative Y direction side and positioned further than the toner cartridge 23F toward the positive Y direction side while extending in the X direction from an end of the second duct portion 43, the end being located on the positive X direction side, to a position adjacent to the toner cartridge 23F on the positive X direction side (a position further than the center of the housing 15 toward the positive X direction side). In other words, the flow direction of a gas inside the third duct portion 44 is in the X direction.

As illustrated in FIG. 2, the cross-sectional area of the first duct portion 42 in the YZ plane, which is perpendicular to the X direction, is denoted by S1. The cross-sectional area of the second duct portion 43 in a plane that is perpendicular to the flow direction of the gas is denoted by S2. The cross-sectional area of the third duct portion 44 in the YZ plane, which is perpendicular to the X direction, is denoted by S3. As an example, the sizes of the cross-sectional areas S1, S2, and S3 are set so as to have a relationship of S1<S2<S3.

(Connecting Portion)

As illustrated in FIG. 2, as an example, the connecting portion 34 is formed in a rectangular parallelepiped shape and includes a bottom wall 34A, a front wall 34B, the rear wall 17A, a left side wall 34C, a right side wall 34D, and a top wall 34E. The bottom wall 34A, the front wall 34B, the rear wall 17A, the left side wall 34C, the right side wall 34D, and the top wall 34E are formed so as to be connected to their adjacent walls with no gaps formed therebetween.

As an example, as viewed in the Y direction, the bottom wall 34A is formed in a rectangular shape having a length L2 in the X direction and a length L3 (>L2) in the Z direction. The length L3 is larger than the above-mentioned length L1. In addition, the length L3 is equal to or larger than the length of the fixing unit 24 (unit body 25) in the Z direction. In the housing 15 (see FIG. 1), the bottom wall 34A is located on the negative Y direction side (is disposed in a lower portion of the housing 15) in such a manner as to extend along the XZ plane. The front wall 34B stands upright along the XY plane at an end of the bottom wall 34A, the end being located on the negative Z direction side. The rear wall 17A is positioned at an end of the bottom wall 34A, the end being located on the positive Z direction side, in such a manner as to extend along the XY plane.

The left side wall 34C stands upright along the YZ plane at an end of the bottom wall 34A, the end being located on the negative X direction side. A through hole 37 extending through the left side wall 34C in the X direction is formed in a portion of the left side wall 34C, the portion being located at the center of the left side wall 34C in the Z direction and being located at an end of the left side wall 34C on the positive Y direction side. As viewed in the X direction, the through hole 37 is formed in a quadrangular shape. An end of the above-mentioned third duct portion 44, the end being located on the positive X direction side, is connected to the circumferential edge of the through hole 37. The right side wall 34D stands upright along the YZ plane at an end of the bottom wall 34A, the end being located on the positive X direction side. A height h2, which is the height of the left side wall 34C in the Y direction and the height of the right side wall 34D in the Y direction, is larger than a height h1 of the third duct portion 44 in the Y direction.

As an example, as viewed in the Y direction, the top wall 34E is formed in a quadrangular shape having the length L2 in the X direction and the length L3 in the Z direction. In the housing 15 (see FIG. 1), the top wall 34E is located on the positive Y direction side in such a manner as to extend along the XZ plane. As viewed in the Z direction, the bottom wall 34A, the left side wall 34C, the right side wall 34D, and the top wall 34E surround the above-mentioned discharge port 19.

As described above, in the housing 15 (see FIG. 1), the connecting portion 34 is positioned further than the center of the housing 15 in the X direction toward the positive X direction side (second side) and is connected to an end of the duct 32, which is opposite to an end of the duct 32 that faces the fixing unit 24 in the X direction, and the discharge port 19. In addition, a cross-sectional area S4 of the connecting portion 34 in the YZ plane, which is perpendicular to the X direction, is larger than the cross-sectional area S3 of the third duct portion 44 in the YZ plane. In other words, the connecting portion 34 is formed so as to be wider than the duct 32 in such a manner that a flow velocity V2 of a gas that flows inside the connecting portion 34 is less than a flow velocity V1 of a gas that flows inside the duct 32. Note that a portion of the gas inside the connecting portion 34 is discharged to outside the housing 15 (see FIG. 1) through the discharge port 19.

(Fan)

As an example, the fan 36 has a rotation axis extending in the X direction and is disposed in the third duct portion 44. In other words, the fan 36 is disposed in the duct 32. In addition, the fan 36 rotates as a result of power being supplied to the fan 36 from a power supply (not illustrated) in response to a command from the control unit 18 (see FIG. 1) and causes a gas to move from the fixing unit 24 to the connecting portion 34 by passing through the inside of the duct 32. As an example, the fan 36 is driven so as to rotate during the period when a fixing operation is performed in the fixing unit 24.

Comparative Example

Figure 8:
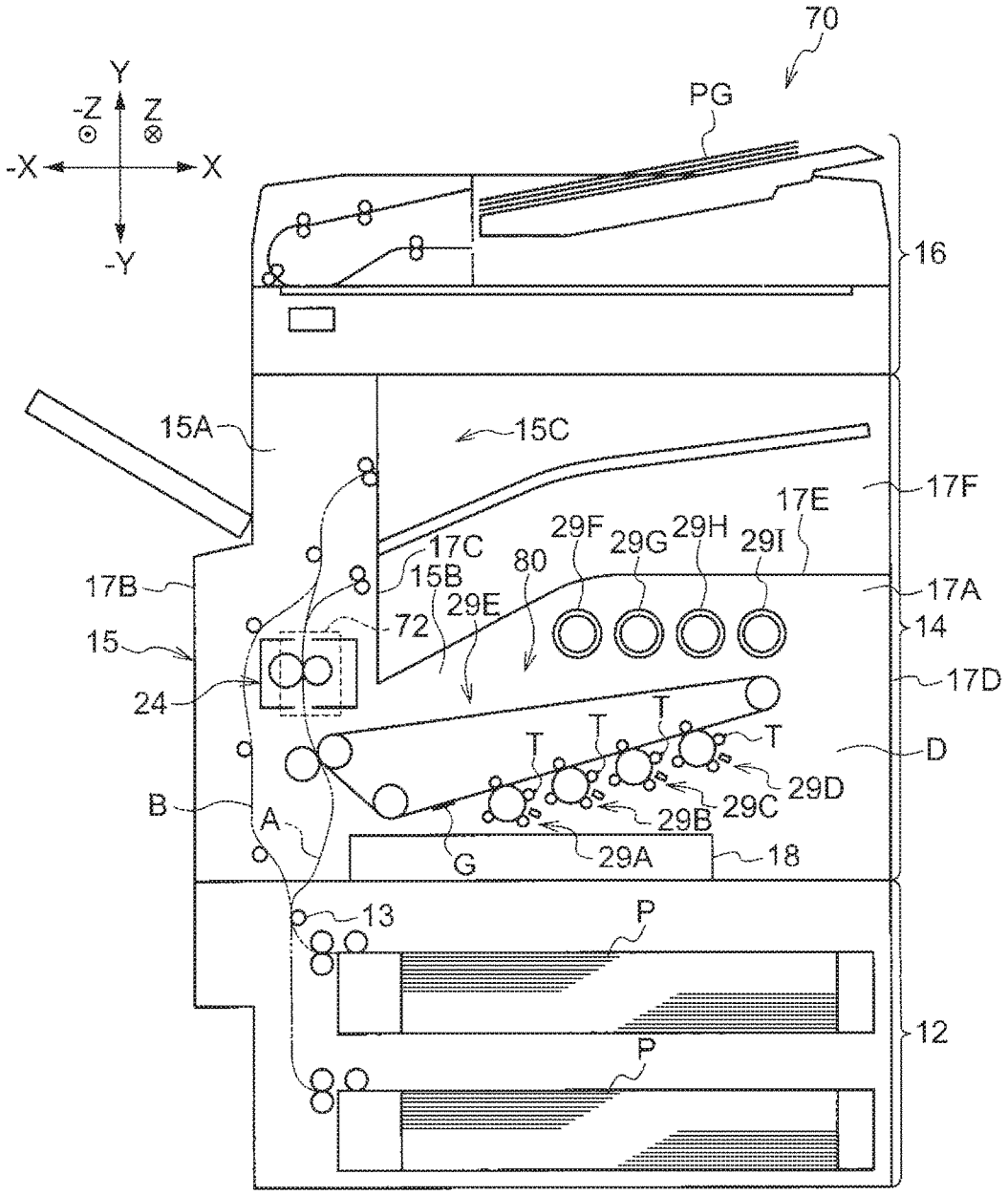
FIG. 8 is a schematic diagram of the image forming apparatus according to the comparative example.

FIG. 8 illustrates an image forming apparatus 70 according to a comparative example (hereinafter simply referred to as comparative example) that forms a toner image G by using toners T of four colors. In the comparative example, image forming units 29A, 29B, 29C, and 29D, a transfer unit 29E, a fixing unit 24, and toner cartridges 29F, 29G, 29H, and 29I are disposed in a housing 15. Note that the image forming units 29A, 29B, 29C, and 29D, the transfer unit 29E, and the fixing unit 24 will hereinafter be collectively referred to as an image forming section 80. In the housing 15 according to the comparative example, a discharge port 72 is formed instead of the discharge port 19 (see FIG. 1). The discharge port 72 is formed so as to be positioned further than the center of a rear wall 17A in the X direction toward the negative X direction side and so as to be positioned further than the fixing unit 24 toward the positive Z direction side.

More specifically, in the comparative example, the image forming units 29A, 29B, 29C, and 29D and the transfer unit 29E, which are included in the image forming section 80, are disposed in a center portion of the housing 15 in the X direction. Accordingly, in the comparative example, the size of an empty space D that is positioned on the positive X direction side of the image forming section 80 in the housing 15 is significantly smaller than the size of the above-mentioned space C (see FIG. 1).

In other words, in the comparative example, the size of the empty space D in the housing 15 is smaller than the above-mentioned space C, and thus, it is difficult to install the exhaust unit 30 according to the first exemplary embodiment (see FIG. 1). Therefore, in the comparative example, a duct (not illustrated) that extends in the Z direction from the unit body 25 (see FIG. 2) of the fixing unit 24 to the exhaust port 72 on the positive Z direction side is provided. The duct according to the comparative example is formed in such a manner that the cross-sectional area of the duct in a plane perpendicular to the flow direction of a gas (Z direction) is constant in the Z direction.

Figure 3A:
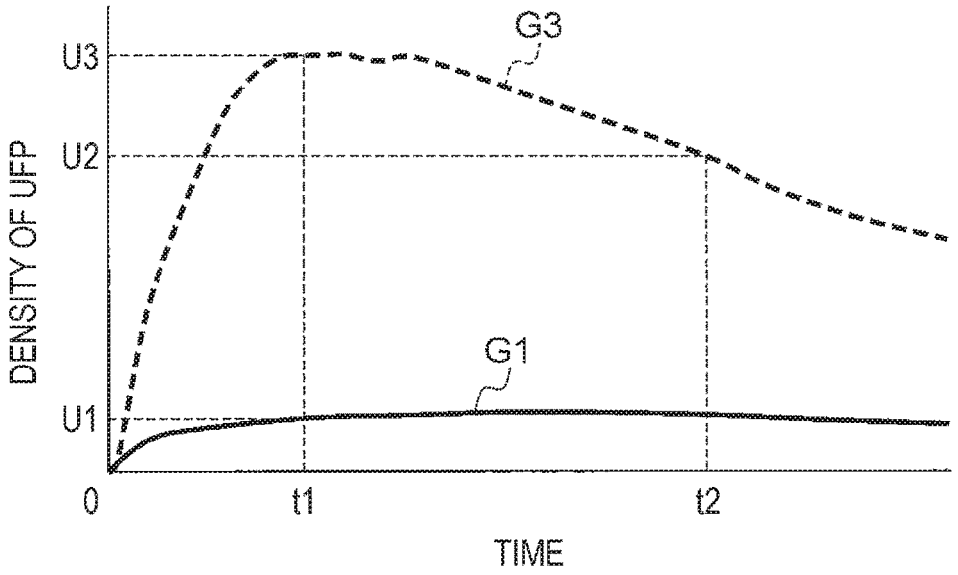
FIGS. 3A and 3B are respectively a graph that compares the image forming apparatus according to the first exemplary embodiment and an image forming apparatus according to a comparative example in terms of density of UFPs and a graph that compares the image forming apparatus according to the first exemplary embodiment and the image forming apparatus according to the comparative example in terms of amount of discharged UFPs per second.

Here, changes in the density [number/$cm^3$] of UFPs discharged from the fixing unit 24 with respect to time in the comparative example are represented by a dotted line G3 in the graph of FIG. 3A. Changes in the amount [number/sec] of the UFPs discharged from the fixing unit 24 per second with respect to time in the comparative example are represented by a dotted line G4 in the graph of FIG. 3B. Note that an engine exhaust particle sizer (EEPS) 3090 manufactured by Tokyo Dylec Corp. and a condensation particle counter (CPC) 3775 manufactured by Tokyo Dylec Corp. are used as measuring devices capable of measuring changes in the density of the UFPs with respect to time and changes in the amount of the discharged UFPs with respect to time.

As represented by the dotted line G3 in the graph of FIG. 3A, in the comparative example, the density of the UFPs increases from the start of a measurement (start of a fixing operation) and reaches a maximum density value U3 at time t1. After reaching the density value U3 at time t1, the density of the UFPs gradually decreases and reaches a density value U2 (<U3) at time t2 (>t1).

As represented by the dotted line G4 in the graph of FIG. 3B, in the comparative example, the amount of the discharged UFPs per second (hereinafter referred to as amount of the discharged UFPs) increases from the start of the measurement (start of the fixing operation) and reaches a maximum value D3 at time ta(<t1). After reaching the value D3 at time ta, the amount of the discharged UFPs gradually decreases and reaches a value D1 (<D3) at time t2.

(Operation)

Operation in the first exemplary embodiment will now be described.

In the image forming apparatus 10 illustrated in FIG. 1, when an image forming operation is performed, the heating roller 26 is heated by the heater (not illustrated) and caused to rotate. Then, after the temperature of the heating roller 26 has increased to a predetermined fixation temperature, the toner image G is formed on one of the sheets P by the image forming unit 22, and the toner T (toner image G) is fixed onto the sheet P by the fixing unit 24. During this operation, the fan 36 rotates.

In the process of fixing the toner T onto the sheet P, a portion of the additives (for example, the release agent) included in the toner T vaporizes in the unit body 25. Then, a gas (air) including the vaporized release agent is drawn in as a result of rotation of the fan 36 and moves from the unit body 25 to the inside of the connecting portion 34 through the duct 32.

In the image forming apparatus 10, the image forming section 20 is disposed on the first side (negative X direction side) in the housing 15, so that a large space including the space C is secured at a position further than the center portion of the housing 15 in the X direction toward the positive X direction side. Thus, in the image forming apparatus 10, the entire length of the duct 32 is larger than that of the duct according to the comparative example, and the connecting portion 34, which is wider than the duct 32, may be accommodated (installed). In other words, in the image forming apparatus 10, the length of a flow path through which the gas flows, the flow path extending from the fixing unit 24 to the exhaust port 19, is larger than the length of a flow path of the gas in the comparative example, and thus, the period from when the release agent vaporizes until the gas is discharged through the exhaust port 19 is longer compared with in the comparative example.

In addition, as illustrated in FIG. 2, in the image forming apparatus 10, the cross-sectional area S4 of the connecting portion 34 in the YZ plane, which is perpendicular to the X direction, is larger than the cross-sectional area S3 of the third duct portion 44 in the YZ plane. Thus, as illustrated in FIG. 1, the flow velocity V2 of the gas that flows inside the connecting portion 34 is less than the flow velocity V1 of the gas that flows inside the third duct portion 44. As a result, the gas including the release agent is likely to stay in the connecting portion 34 compared with the configuration in which the connecting portion 34 is not provided.

Fine particles of the release agent included in the gas, which stays in the connecting portion 34 without reaching the exhaust port 19, are bonded to one another during the period when they are staying in the connecting portion 34 and become particles each having a diameter larger than that of a fine particle (a diameter larger than 0.1 μm). It is found that the ratio of the fine particles that become particles by being bonded to one another to the fine particles that will not become particles increases as the length of time over which the fine particles float increases. In the image forming apparatus 10, the time taken for the fine particles to be discharged through the exhaust port 19 may be longer than the time taken for the fine particles to be discharged through the discharge port 72 in the comparative example, and thus, the probability that the fine particles of the additives will be discharged to outside the housing 15 is reduced. The additives, which have become particles, are discharged together with the gas to outside the housing 15 through the exhaust port 19 by an air blowing operation performed by the fan 36 and by a pressure difference between the area inside the connecting portion 34 and the area outside the housing 15.

As represented by a solid line G1 in the graph of FIG. 3A, in the image forming apparatus 10 (see FIG. 1), although the density of the UFPs increases from the start of a measurement (start of a fixing operation), the maximum density value at time t1 is a density value U1 (<U2), which is lower than that in the comparative example. After reaching the density value U1 at time t1, the density of the UFPs gradually decreases.

Figure 3B:
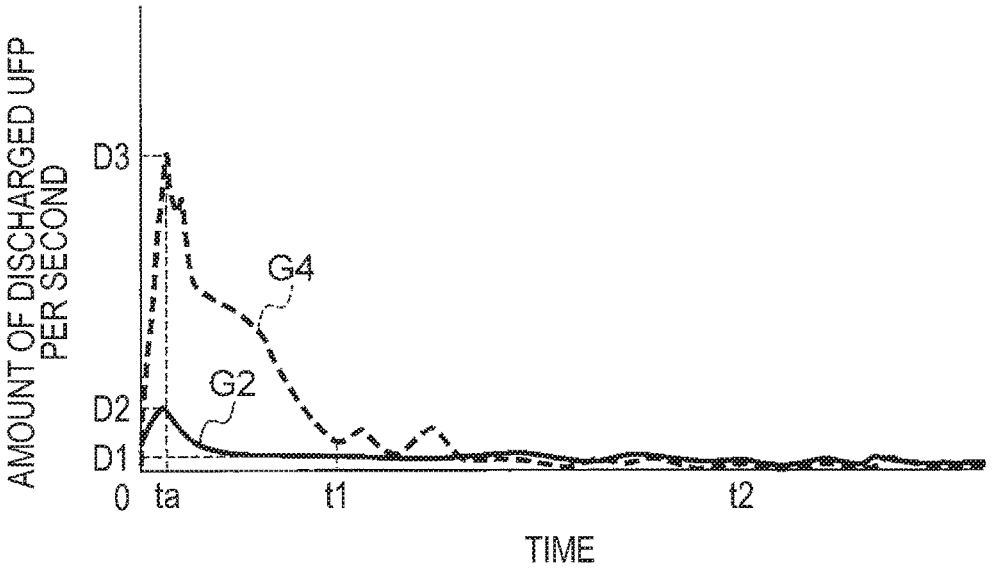

As represented by a solid line G2 in the graph of FIG. 3B, in the image forming apparatus 10 (see FIG. 1), the amount of the discharged UFPs increases from the start of the measurement (start of the fixing operation) and reaches a maximum value D2 (<D3) at time ta. After reaching the value D2 at time ta, the amount of the discharged UFPs gradually decreases and reaches a value D1 (<D2) at time t2. As described above, in the image forming apparatus 10 illustrated in FIG. 1, the gas including the additives, which have become particles each having a large diameter, is discharged to outside the housing 15, and thus, the probability that the fine particles of the additives will be discharged to outside the housing 15 is lower than that in the comparative example.

In addition, in the image forming apparatus 10, the fan 36 is disposed in the duct 32, which is closer to the fixing unit 24 than the connecting portion 34 is. Thus, the time taken for the gas to start moving from the fixing unit 24 toward the duct 32 is shorter than that in the configuration in which the fan 36 is disposed in the connecting portion 34, and consequently, an increase in the temperature of the fixing unit 24 is suppressed.

Second Exemplary Embodiment

An example of an image forming apparatus according to a second exemplary embodiment of the present invention will now be described. Note that members and portions that are basically the same as those of the above-described image forming apparatus 10 according to the first exemplary embodiment are denoted by the same reference numerals as used in the first exemplary embodiment, and descriptions thereof will be omitted.

Figure 4:
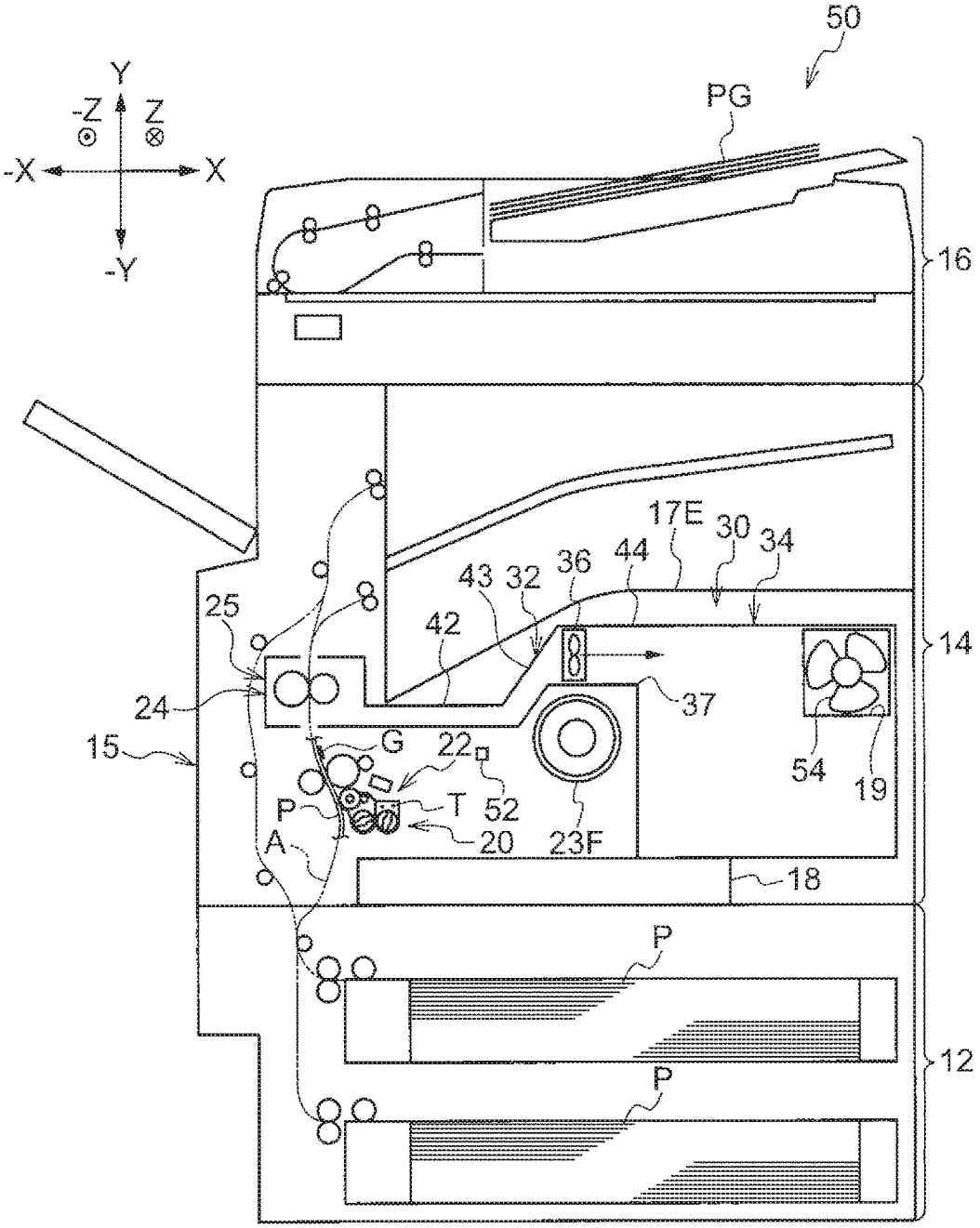
FIG. 4 is a schematic diagram illustrating the overall configuration of an image forming apparatus according to a second exemplary embodiment.

FIG. 4 illustrates an image forming apparatus 50 according to the second exemplary embodiment. The image forming apparatus 50 is obtained by adding a temperature sensor 52 and a discharge fan 54 to the above-described image forming apparatus 10 (see FIG. 1). The temperature sensor 52 is an example of a sensing unit. The discharge fan 54 is an example of a discharge unit. The control unit 18 is another example of a discharge unit.

(Temperature Sensor)

The temperature sensor 52 is formed of a commonly known sensor that is capable of detecting the ambient temperature and is disposed, as an example, in the center portion of the housing 15 in the X direction, the Y direction, and the Z direction (in the vicinity of the toner cartridge 23F). The temperature sensor 52 is configured to detect the temperature in the housing 15 and to transmit detected information to the above-mentioned control unit 18.

(Discharge Fan)

As an example, the discharge fan 54 has a rotation axis extending in the Z direction and is installed in the connecting portion 34 in such a manner as to cover the exhaust port 19. In addition, the discharge fan 54 is configured to discharge a gas inside the connecting portion 34 to outside the housing 15 through the exhaust port 19 as a result of being driven and controlled by the control unit 18. The control unit 18 is configured to drive the discharge fan 54 when the temperature in the housing 15 detected by the temperature sensor 52 is higher than a predetermined temperature.

Note that the moving unit is a unit that causes, like the fan 36, a gas including fine particles in the fixing unit 24 to move to the connecting portion 34 through the duct 32. In other words, the moving unit is a unit that draws in the gas including the fine particles in the fixing unit 24 and discharges the gas to the connecting portion 34. On the other hand, the discharge unit is a unit that discharges, like the discharge fan 54, a gas including particles in the connecting portion 34 to outside the housing 15. That is to say, the moving unit is a unit that moves the gas including the fine particles from the fixing unit 24 to the connecting portion 34, and the discharge unit is a unit that moves the gas including the particles from the connecting portion 34 to outside the housing 15.

(Operation)

Operation in the second exemplary embodiment will now be described.

In the image forming apparatus 50 illustrated in FIG. 4, the toner image G is formed on one of the sheets P by the image forming unit 22, and the toner T (toner image G) is fixed onto the sheet P by the fixing unit 24. During this operation, the fan 36 starts rotating. During this operation, the discharge fan 54 is not rotating.

In the process of fixing the toner T onto the sheet P, a portion of the additives (for example, the release agent) included in the toner T vaporizes in the unit body 25. Then, a gas (air) including the vaporized release agent is drawn in as a result of rotation of the fan 36 and moves from the unit body 25 to the inside of the connecting portion 34 through the duct 32. As a result, the gas including the release agent stays in the connecting portion 34, and the fine particles of the release agent in the gas become particles each having a large diameter. Then, the additives, which have become particles, are discharged together with the gas to outside the housing 15 through the exhaust port 19 by an air blowing operation performed by the fan 36 and by a pressure difference between the area inside the connecting portion 34 and the area outside the housing 15.

In the case of forming images on a large number of the sheets P (in the case where the length of time for performing an image forming operation is long), a high-temperature gas moves, in a continuous manner, from the fixing unit 24 to the connecting portion 34 through the duct 32, and thus, the temperatures of the walls, which are included in the duct 32 and the connecting portion 34, may sometimes be increased (raised). In this case, the temperature in the housing 15 is also increased.

Figure 5:
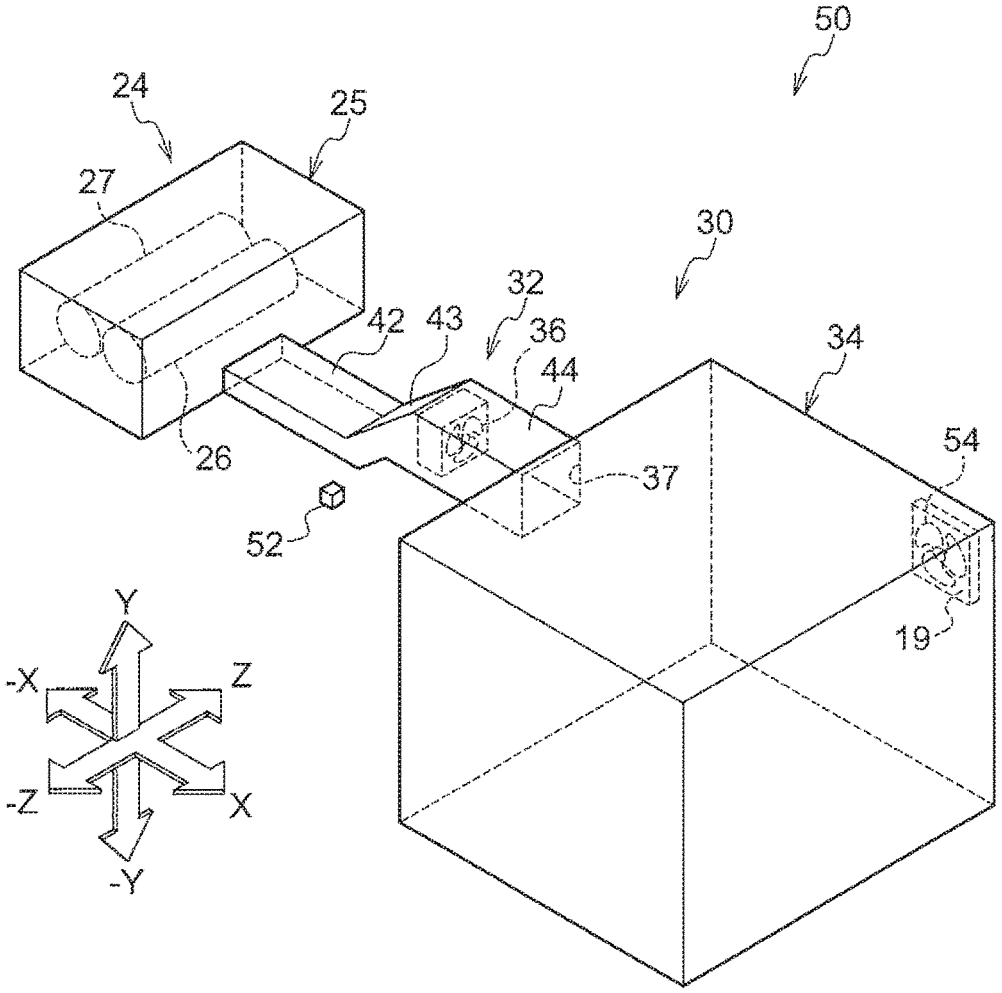
FIG. 5 is a perspective view illustrating a fixing unit, a duct, and a connecting portion according to the second exemplary embodiment.

As illustrated in FIG. 5, in the image forming apparatus 50, when the temperature detected by the temperature sensor 52 is higher than a predetermined temperature, the control unit 18 (see FIG. 4) performs drive control of the fan 36 and the discharge fan 54. Thus, a portion of the gas staying in the connecting portion 34 is discharged to outside the housing 15 (see FIG. 4) through the discharge fan 54 and the exhaust port 19. As a result, the probability that the duct 32 and the connecting portion 34 will store heat is reduced compared with the configuration in which the temperature sensor 52 and the discharge fan 54 are not provided, and accordingly, an increase in the temperature in the housing 15 is suppressed. Note that, as described above, the amount of the UFPs increases immediately after a fixing operation has started and then decreases. Therefore, in a state where a certain time that is long enough for the temperature detected by the temperature sensor 52 to become higher than the predetermined temperature has passed, even if the gas is discharged as a result of rotation of the discharge fan 54, the amount of the UFPs discharged to outside the housing 15 is smaller compared with in the comparative example.

Third Exemplary Embodiment

An example of an image forming apparatus according to a third exemplary embodiment of the present invention will now be described. Note that members and portions that are basically the same as those of the image forming apparatus 10 according to the first exemplary embodiment and the image forming apparatus 50 according to the second exemplary embodiment, which are described above, are denoted by the same reference numerals as used in the first and second exemplary embodiments, and descriptions thereof will be omitted.

Figure 6:
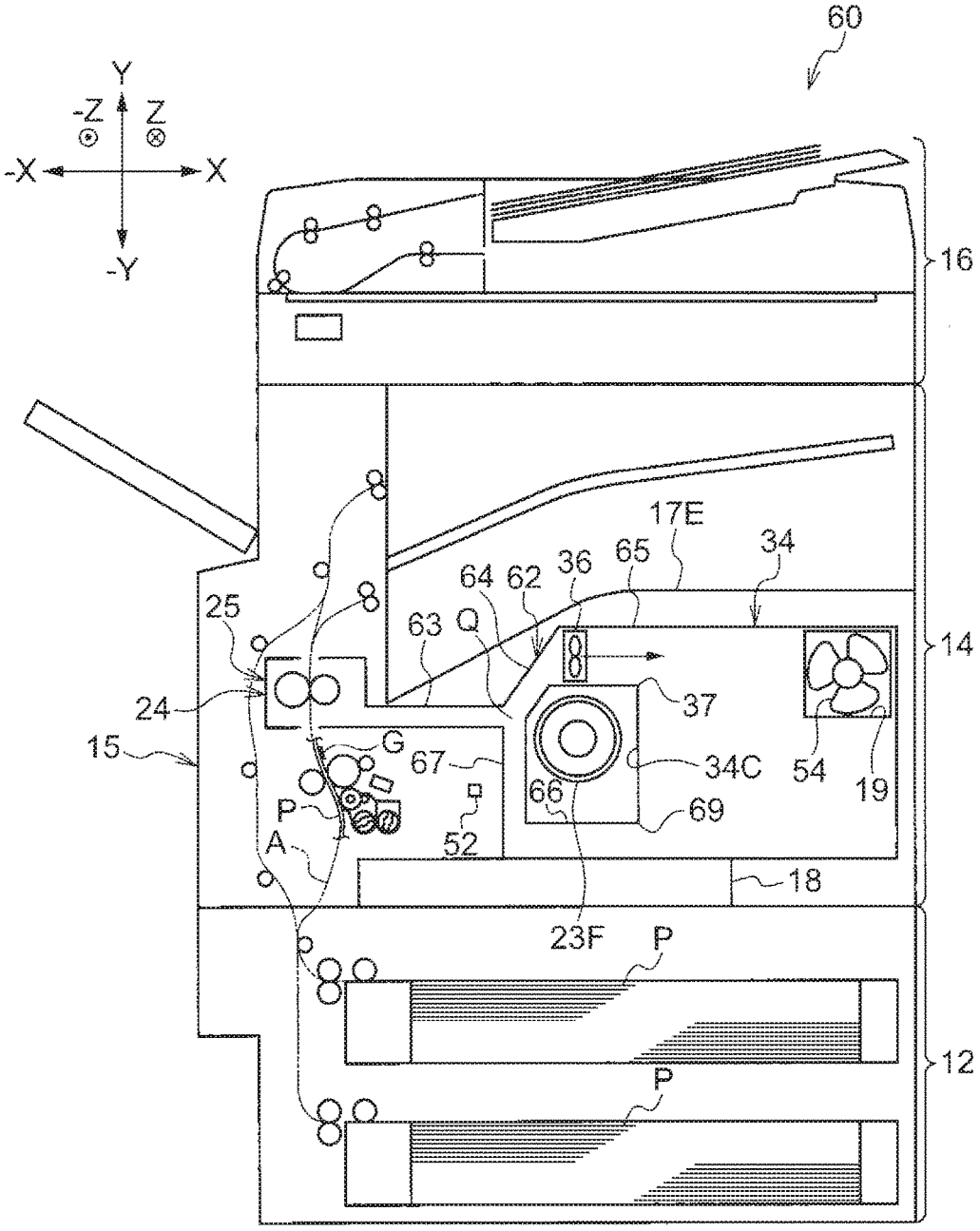
FIG. 6 is a schematic diagram illustrating the overall configuration of an image forming apparatus according to a third exemplary embodiment.

FIG. 6 illustrates an image forming apparatus 60 according to the third exemplary embodiment. The image forming apparatus 60 is obtained by replacing the duct 32 (see FIG. 4) with a duct 62 in the above-described image forming apparatus 50 (see FIG. 4). A through hole 69 extending through the left side wall 34C in the X direction is formed in a portion of the left side wall 34C of the connecting portion 34, the portion being located at the center of the left side wall 34C in the Z direction and being located at an end of the left side wall 34C on the negative Y direction side. As viewed in the X direction, the through hole 69 is formed in a rectangular shape, a longitudinal direction of which is in the Z direction and a lateral direction of which is in the Y direction. An end of a fourth duct portion 66, which will be described below, the end being located on the positive X direction side, is connected to the circumferential edge of the through hole 69.

Figure 7:
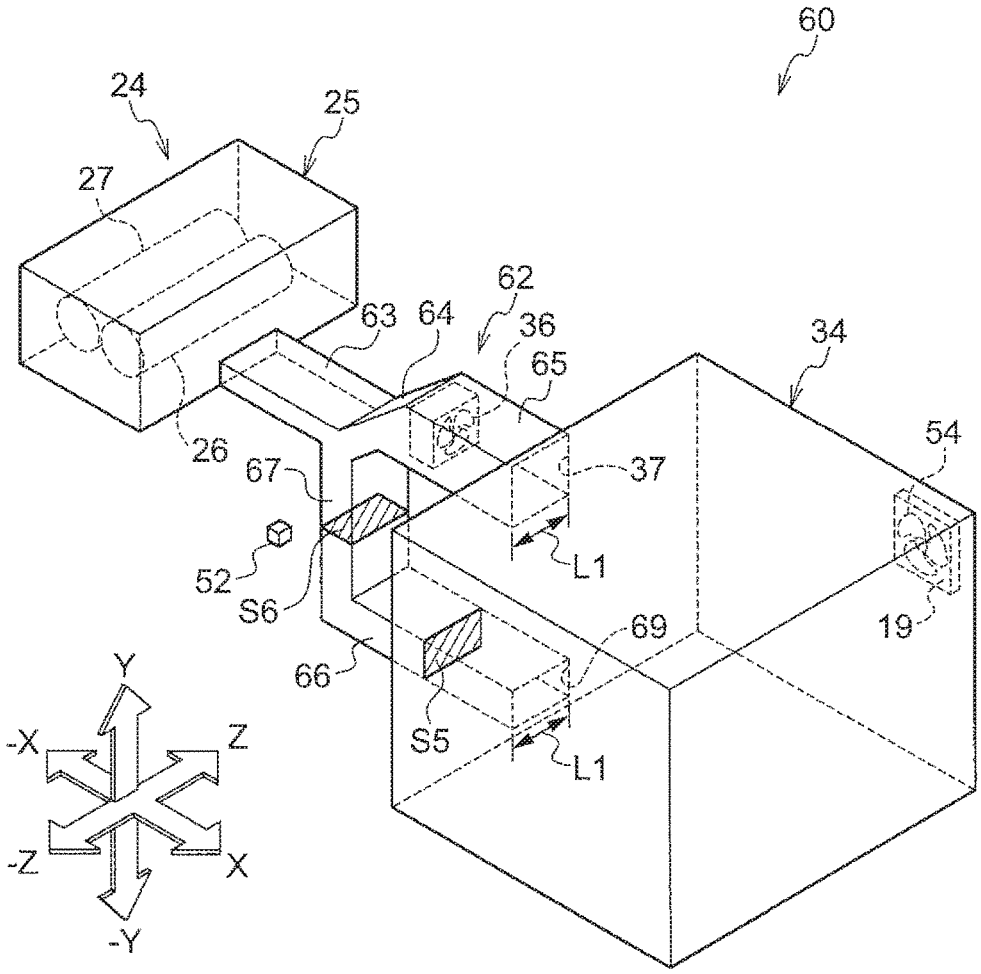
FIG. 7 is a perspective view illustrating a fixing unit, a duct, and a connecting portion according to the third exemplary embodiment.

In the housing 15, the duct 62 extends from the vicinity of the fixing unit 24 (the vicinity of an end portion of the fixing unit 24, the end portion being located on the positive X direction side and the negative Y direction side) to a position further than the center of the housing 15 in the X direction toward the positive X direction side (the second side). In addition, as illustrated in FIG. 7, the duct 62 includes, as an example, a first duct portion 63, a second duct portion 64, a third duct portion 65, the fourth duct portion 66, and a fifth duct portion 67. Each of the first duct portion 63, the second duct portion 64, the third duct portion 65, the fourth duct portion 66, and the fifth duct portion 67 is formed in a square cylindrical shape and has the length L1 in the Z direction.

The first duct portion 63 is configured in a similar manner to the above-mentioned first duct portion 42 (see FIG. 5). The second duct portion 64 is configured in a similar manner to the above-mentioned second duct portion 43 (see FIG. 5). The third duct portion 65 is configured in a similar manner to the above-mentioned third duct portion 44 (see FIG. 5). Note that each of the second duct portion 64 and the third duct portion 65 is an example of a first flow path. The fan 36 is disposed in only the third duct portion 65.

As illustrated in FIG. 6, as viewed in the Z direction, the fourth duct portion 66 is positioned further than the toner cartridge 23F toward the negative Y direction side and extends in the X direction from the through hole 69 of the left side wall 34C of the connecting portion 34 to a position further than the position of the cartridge 23F toward the negative X direction side. As viewed in the Z direction, the fifth duct portion 67 is positioned further than the toner cartridge 23F toward the negative X direction side and extends in the Y direction from an end of the fourth duct portion 66, the end being located on the negative X direction side, in such a manner as to be connected to a connecting portion Q in which the first duct portion 63 and the second duct portion 64 are connected to each other. Note that each of the fourth duct portion 66 and the fifth duct portion 67 is an example of a second flow path.

In other words, a portion of the duct 62, the portion facing the connecting portion 34, is separated into a first portion, which includes the second duct portion 64 and the third duct portion 65, and a second portion, which includes the fifth duct portion 67 and the fourth duct portion 66, and the first portion and the second portion are connected to the connecting portion 34. In the duct 62, a gas flows through the first duct portion 63, the second duct portion 64, the third duct portion 65, the connecting portion 34, the fourth duct portion 66, and the fifth duct portion 67 in this order and flows in the second duct portion 64 again (circulates through the duct 62 and the connecting portion 34).

The cross-sectional area of the fourth duct portion 66 in the YZ plane, which is perpendicular to the X direction, is denoted by S5, and the cross-sectional area of the fifth duct portion 67 in a plane that is perpendicular to the flow direction of the gas is denoted by S6. As an example, the sizes of the cross-sectional areas S5 and S6 are set in such a manner that the cross-sectional areas S5 and S6 and the above-mentioned cross-sectional areas S1, S2, S3, and S4 (see FIG. 2) have a relationship of $S6<S1<S2<S5<S3<S4$.

(Operation)

Operation in the third exemplary embodiment will now be described.

In the image forming apparatus 60 illustrated in FIG. 6, the toner image G is formed on one of the sheets P by the image forming unit 22, and the toner T (toner image G) is fixed onto the sheet P by the fixing unit 24. During this operation, the fan 36 starts rotating.

In the process of fixing the toner T onto the sheet P, a portion of the additives (for example, the release agent) included in the toner T vaporizes in the unit body 25. Then, a gas (air) including the vaporized release agent is drawn in as a result of rotation of the fan 36 and moves from the unit body 25 to the inside of the connecting portion 34 through the duct 62. As a result, the gas including the release agent stays in the connecting portion 34, and the fine particles of the release agent in the gas become particles each having a large diameter. Then, the additives, which have become particles, are discharged together with the gas to outside the housing 15 through the exhaust port 19 by an air blowing operation performed by the fan 36 and by a pressure difference between the area inside the connecting portion 34 and the area outside the housing 15.

In the image forming apparatus 60, when the temperature detected by the temperature sensor 52 is higher than a predetermined temperature, the control unit 18 performs drive control of the fan 36 and the discharge fan 54. Thus, a portion of the gas staying in the connecting portion 34 is discharged to outside the housing 15 through the discharge fan 54 and the exhaust port 19. As a result, the probability that the duct 62 and the connecting portion 34 will store heat is reduced compared with the configuration in which the temperature sensor 52 and the discharge fan 54 are not provided, and accordingly, an increase in the temperature in the housing 15 is suppressed.

In addition, in the image forming apparatus 60, a portion of the gas staying in the connecting portion 34 flows through the inside of the fourth duct portion 66 and the inside of the fifth duct portion 67 as a result of the fan 36 operating. Then, a portion of the gas in the connecting portion 34 flows in the second duct portion 64 via the above-mentioned connecting portion Q, and the portion of the gas flows through the inside of the third duct portion 65 and flows in the connecting portion 34 again. In other words, in the image forming apparatus 60, a portion of the gas staying in the connecting portion 34 circulates through the duct 62 and the connecting portion 34 before being discharged through the exhaust port 19. Thus, compared with the configuration in which the fourth duct portion 66 and the fifth duct portion 67 are not provided, the time taken for the gas to be discharged to outside the housing 15 is long. As a result, the number of the fine particles of the release agent that are bonded to one another before being discharged increases, and thus, the probability that the fine particles of the release agent may be discharged to outside the housing 15 is reduced more than that in the image forming apparatus 50 (FIG. 4).

Note that the present invention is not limited to the above-described exemplary embodiments.

In each of the image forming apparatuses 50 and 60, instead of using the temperature sensor 52, the number of the sheets P on which images are to be formed may be counted, and when the counted number is greater than a predetermined number, the discharge fan 54 may be driven.

In each of the image forming apparatuses 10, 50, and 60, the exhaust port 19 may be provided with a filter capable of collecting some of the UFPs. In addition, in each of the image forming apparatuses 10, 50, and 60, the fan 36 is not limited to being installed in the ducts 32 and 62 and may be installed in the connecting portion 34.

In the image forming apparatus 60, the fan 36 may be installed in the fourth duct portion 66 or the fifth duct portion 67. In this configuration, the fan 36 may cause the gas to flow in a direction toward the second duct portion 64 or may cause the gas to flow in a direction toward the connecting portion 34. In the image forming apparatus 60, the fan 36 may be installed both in the first portion, which includes the second duct portion 64 and the third duct portion 65, and the second portion, which includes the fourth duct portion 66 and the fifth duct portion 67, and may be driven so as to move the gas to the connecting portion 34 without causing the gas to circulate.

The first duct portion 42, the second duct portion 43, the third duct portion 44, the first duct portion 63, the second duct portion 64, the third duct portion 65, the fourth duct portion 66, and the fifth duct portion 67 may have different widths in the Z direction. The height of each of the duct portions in the Y direction and the length of each of the duct portions in the X direction may be set so as to be different from those of the duct portions in the first, second, and third exemplary embodiments. In other words, although it is a requirement that the cross-sectional area S4 of the connecting portion 34 is larger than each of the cross-sectional areas S1, S2, S3, S5, and S6 of the ducts 32 and 62, the size relationship of the cross-sectional areas S1, S2, S3, S5, and S6 may be different from those in the above-described exemplary embodiments.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body in which a discharge port is formed;

an image forming section that is positioned further than the center of the apparatus body in a width direction toward a first side and that includes a developer-image forming unit configured to form a developer image on a recording medium by using a developer including an additive and a fixing unit configured to fix the developer image onto the recording medium by heating the developer;

a duct that extends, in the apparatus body, in a longitudinal direction from a vicinity of the fixing unit to a position further than the center of the apparatus body in the width direction toward a second side;

a connecting portion that is connected, on the second side in the apparatus body, to a portion of the duct, which is opposite to a portion of the duct that faces the fixing unit, and the discharge port and that is formed so as to be wider than the duct in such a manner that a flow velocity of a gas that flows inside the connecting portion is less than a flow velocity of a gas that flows inside the duct; and a moving unit that causes a gas to move from the fixing unit to the connecting portion by passing through the inside of the duct, wherein an entire width of the connecting portion in a horizontal direction perpendicular to the longitudinal direction is larger than an entire width of the duct in the horizontal direction.

2. The image forming apparatus according to claim 1, wherein the moving unit is disposed in the duct.

3. The image forming apparatus according to claim 2, further comprising:

a sensing unit configured to detect a temperature in the apparatus body; and a discharge unit configured to discharge the gas inside the connecting portion through the discharge port when the temperature in the apparatus body, which has been detected by the sensing unit, is higher than a predetermined temperature.

4. The image forming apparatus according to claim 3, wherein the portion of the duct connected to the connecting portion is separated into a first flow path and a second flow path each of which is connected to the connecting portion, and wherein the moving unit is disposed in only the first flow path.

5. The image forming apparatus according to claim 2, wherein the portion of the duct connected to the connecting portion is separated into a first flow path and a second flow path each of which is connected to the connecting portion, and wherein the moving unit is disposed in only the first flow path.

6. The image forming apparatus according to claim 1, further comprising:

a sensing unit configured to detect a temperature in the apparatus body; and a discharge unit configured to discharge the gas inside the connecting portion through the discharge port when the temperature in the apparatus body, which has been detected by the sensing unit, is higher than a predetermined temperature.

7. The image forming apparatus according to claim 6, wherein the portion of the duct connected to the connecting portion is separated into a first flow path and a second flow path each of which is connected to the connecting portion, and wherein the moving unit is disposed in only the first flow path.

8. The image forming apparatus according to claim 1, wherein the portion of the duct connected to the connecting portion is separated into a first flow path and a second flow path each of which is connected to the connecting portion, and wherein the moving unit is disposed in only the first flow path.

9. The image forming apparatus according to claim 1, wherein a cross-sectional area of the connecting portion in a plane that is perpendicular to the longitudinal direction is larger than a cross-sectional area of the duct in the plane.

10. An image forming apparatus comprising:

an apparatus body in which a discharge port is formed;

an image forming section that is positioned further than the center of the apparatus body in a width direction toward a first side and that includes a developer-image forming unit configured to form a developer image on a recording medium by using a developer including an additive and a fixing unit configured to fix the developer image onto the recording medium by heating the developer;

a duct that extends, in the apparatus body, in a longitudinal direction from a vicinity of the fixing unit to a position further than the center of the apparatus body in the width direction toward a second side;

a connecting portion that is connected, on the second side in the apparatus body, to a portion of the duct, which is opposite to a portion of the duct that faces the fixing unit, and the discharge port and whose cross-sectional area in a plane that is perpendicular to the longitudinal direction is larger than a cross-sectional area of the duct in the plane; and a moving unit that causes a gas to move from the fixing unit to the connecting portion by passing through the inside of the duct, wherein an entire width of the connecting portion in a horizontal direction perpendicular to the longitudinal direction is larger than an entire width of the duct in the horizontal direction.

11. The image forming apparatus according to claim 10, wherein the moving unit is disposed in the duct.

12. The image forming apparatus according to claim 11, further comprising:

a sensing unit configured to detect a temperature in the apparatus body; and a discharge unit configured to discharge the gas inside the connecting portion through the discharge port when the temperature in the apparatus body, which has been detected by the sensing unit, is higher than a predetermined temperature.

13. The image forming apparatus according to claim 12, wherein the portion of the duct connected to the connecting portion is separated into a first flow path and a second flow path each of which is connected to the connecting portion, and wherein the moving unit is disposed in only the first flow path.

14. The image forming apparatus according to claim 11, wherein the portion of the duct connected to the connecting portion is separated into a first flow path and a second flow path each of which is connected to the connecting portion, and wherein the moving unit is disposed in only the first flow path.

15. The image forming apparatus according to claim 10, further comprising:

a sensing unit configured to detect a temperature in the apparatus body; and a discharge unit configured to discharge the gas inside the connecting portion through the discharge port when the temperature in the apparatus body, which has been detected by the sensing unit, is higher than a predetermined temperature.

16. The image forming apparatus according to claim 15, wherein the portion of the duct connected to the connecting portion is separated into a first flow path and a second flow path each of which is connected to the connecting portion, and wherein the moving unit is disposed in only the first flow path.

17. The image forming apparatus according to claim 10, wherein the portion of the duct connected to the connecting portion is separated into a first flow path and a second flow path each of which is connected to the connecting portion, and wherein the moving unit is disposed in only the first flow path.

* * * * *